US006332247B1

(12) United States Patent
Hsieh

(10) Patent No.: US 6,332,247 B1
(45) Date of Patent: Dec. 25, 2001

(54) TWO-PIECE CLIP WITH ELASTICALLY ADJUSTABLE FERRULE

(76) Inventor: Ming-Jen Hsieh, No. 21, Mu Hsin Road, Section 3, Wen Shan District, Taipei (TW)

( * ) Notice: Subject to any disclaimer, the term of this patent is extended or adjusted under 35 U.S.C. 154(b) by 0 days.

(21) Appl. No.: 09/545,502

(22) Filed: Apr. 7, 2000

(51) Int. Cl.[7] ..... B43K 25/00

(52) U.S. Cl. ..... 24/11 R; 24/11 F; 24/11 HC; 24/10 R

(58) Field of Search ..... 24/10 R, 11 C, 24/11 CC, 11 F, 3.12, 11 R, 11 HC; 401/104

(56) References Cited

U.S. PATENT DOCUMENTS

| | | | | |
|---|---|---|---|---|
| Re. 13,596 | * | 7/1913 | Van Valkenburg | 56/68 |
| 475,485 | * | 5/1892 | Campbell | 15/105.53 |
| 506,008 | * | 10/1893 | Matthews | 248/688 |
| 1,607,894 | * | 11/1926 | Johnson | 40/334 |
| 2,078,249 | * | 4/1937 | Hotson | 177/127 |
| 4,285,101 | * | 8/1981 | Hanna | 24/3.12 |
| 5,114,258 | * | 5/1992 | Yasunaga | 401/202 |

FOREIGN PATENT DOCUMENTS

| | | | | |
|---|---|---|---|---|
| 37 05 138-A1 | * | 9/1988 | (DE) | 24/10 R |
| 2 569 616-A1 | * | 3/1986 | (FR) | 24/11 R |

* cited by examiner

*Primary Examiner*—James R. Brittain
*Assistant Examiner*—Ruth C. Rodriquez
(74) *Attorney, Agent, or Firm*—Dougherty & Troxell

(57) ABSTRACT

A two-piece clip including an elastically adjustable ferrule and a clip member detachably connected to the ferrule is provided. The ferrule is formed from a long strip of metal material with suitable elasticity and rigidity and having a predetermined inner diameter. Two free end portions of the strip forming the ferrule are caused to cross each other to form a handle portion outside the ferrule. By applying a compressive force on the handle portion to push the two free end portions inward relative to each other, the inner diameter of the ferrule is elastically enlarged for easily putting the ferrule around a pen. The outermost ends of the two free end portions are curved to form two small hollow cylinders, into which the clip member is detachably inserted and thereby connected to the ferrule. The clip member has a small length upward projected from the ferrule for connecting one or more ornamental or advertising article thereto.

9 Claims, 4 Drawing Sheets

TWO-PIECE CLIP WITH ELASTICALLY ADJUSTABLE FERRULE

BACKGROUND OF THE INVENTION

The present invention relates to a two-piece clip with an elastically adjustable ferrule, and more particularly to a two-piece clip having a ferrule that is formed from an elastic strip with two free end portions of the strip crossing each other to locate outside the ferrule. By compressing the crossed free end portions toward each other, the ferrule may be diametrically enlarged for easily putting it around a pen. The two crossed free end portions are curved at their outermost ends to form two hollow cylinders into which a clip member is detachably inserted. The clip member has a small length upward projected from the hollow cylinders for connecting one or more ornamental or advertising articles thereto.

A clip mounted on a pen is usually an integrally formed metal member or plastic member with sufficient elasticity and rigidity. This type of clip includes a horizontal top ring for putting on a top of the pen and being fixed thereto by a fastening means and a vertical arm integrally extended from the horizontal ring to elastically abut on a body of the pen. The horizontal ring of the clip must have a size exactly matching with the diameter of the pen top. The same one clip could not be used on other pen having different top diameter or shape. And, once the horizontal ring is fastened to the pen top, the whole clip would not be able to be easily dismounted from the pen or move to some other position on the pen. It is therefore desirable to develop a clip that is not subject to the above-mentioned restrictions and can be used as an ornamental or advertising means to increase the value thereof.

SUMMARY OF THE INVENTION

A primary object of the present invention is to provide a two-piece clip includes two easily detachably connected parts, namely, a ferrule and a clip member. The ferrule is formed from a long metal strip with sufficient elasticity and rigidity and suitable width. Two free end portions of the long strip cross each other to locate outside the ferrule. Thereby, by applying a compressive force on the two crossed free end portions, the ferrule is elastically and diametrically enlarged to facilitate easy mounting or dismounting of the ferrule around or from a pen; and by releasing the two free end portions, the ferrule immediately returns to its original diameter and can be firmly located on the pen.

Another object of the present invention is to provide a two-piece clip includes two easily detachably connected parts, namely, a ferrule and a clip member. The ferrule is formed from a long metal strip with sufficient elasticity and rigidity and suitable width. Two free end portions of the long strip cross each other to locate outside the ferrule. Outermost ends of the two crossed free end portions are inward or outward curved to form two hollow cylinders that on the one hand serve as areas to facilitate applying a compressive force on the two free end portions for elastically adjusting the diameter of the ferrule, and on the other hand receive an upper end of the clip member therein. The upper end of the clip member received in the hollow cylinders of the ferrule may have a small length upward projected from the ferrule for an ornamental or advertising article to connect thereto and therefore gives the clip added values.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
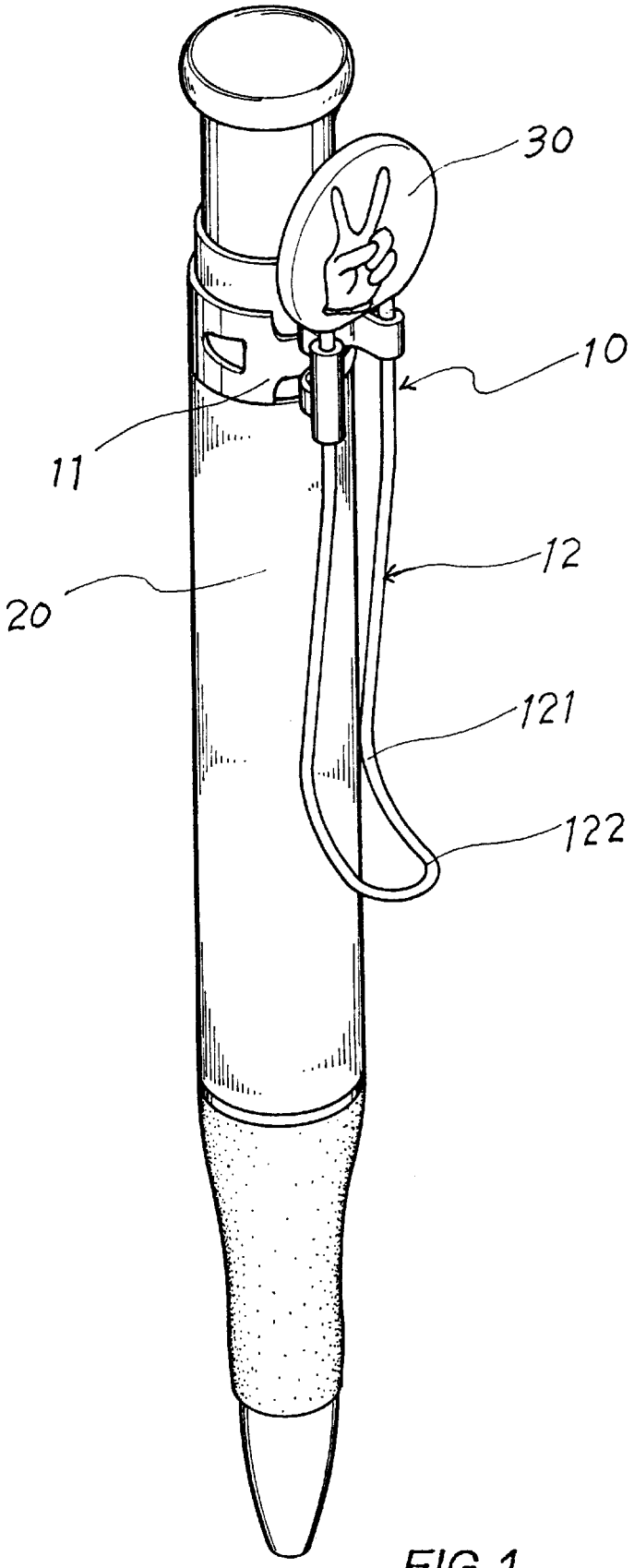
FIG. 1 is an assembled perspective of a two-piece clip according to the present invention having been mounted on a pen with a flat ornament connected to the clip.
Figure 2:
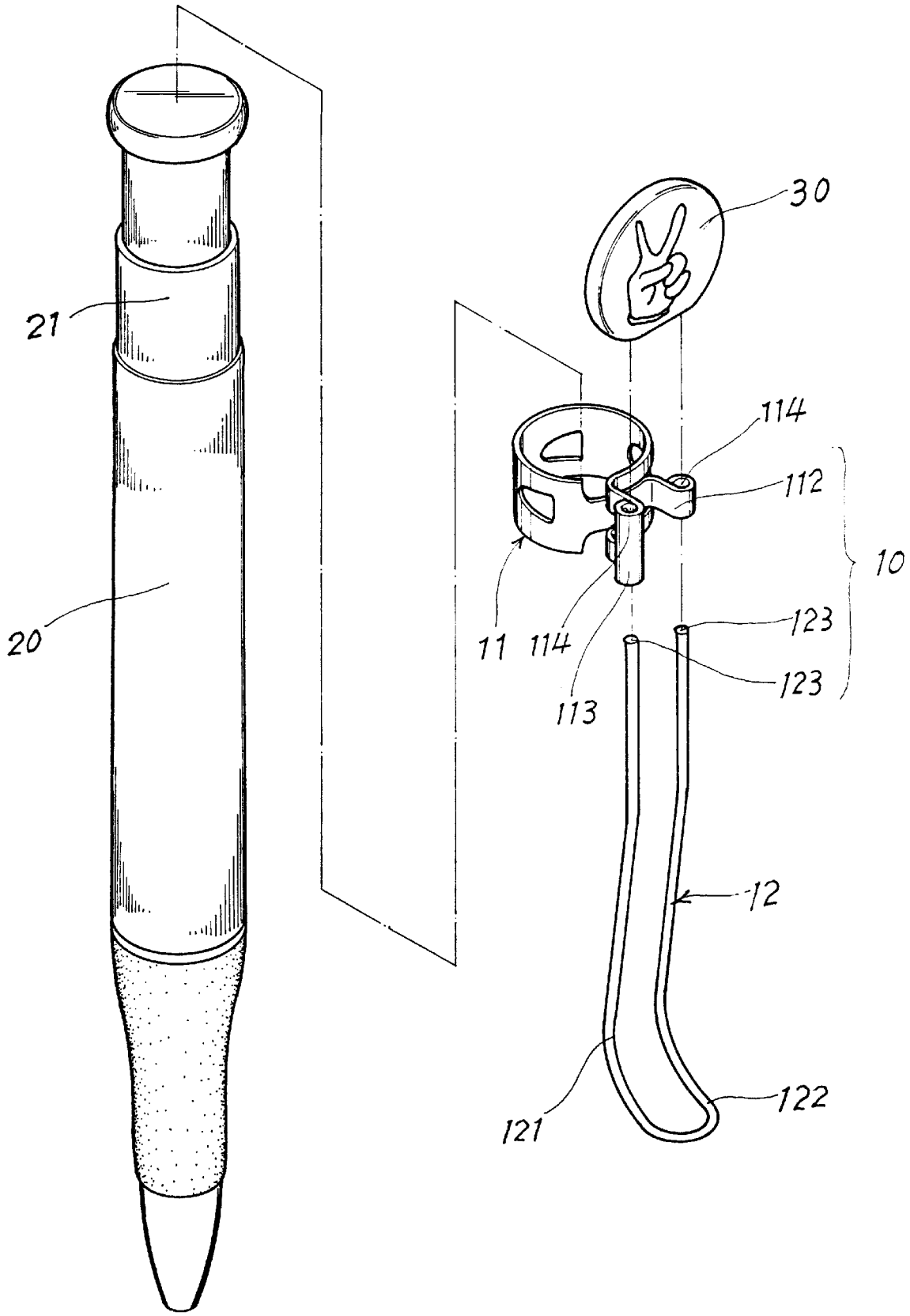
FIG. 2 is an exploded perspective of FIG. 1.

Please refer to FIGS. 1 and 2 that are assembled and exploded perspective views, respectively, of a two-piece clip 10 having an elastically adjustable ferrule 11 according to the present invention being mounted on a pen 20. The two-piece clip 10 mainly includes a ferrule 11 and a clip member 12 that are detachably connected to each other.

The ferrule 11 may be formed from, for example, a ferrous metal strip with suitable elasticity and rigidity and having a predetermined width by means of forging or punching, so that the ferrule 11 is in the form of a lashing ring with a suitable inner diameter. Two free end portions 112, 113 of the metal strip forming the ferrule 11 are caused to cross each other to provide a handle portion 111 (see FIG. 3). To cross the two free end portions 112, 113, the width of the first free end portion 112 is reduced by a predetermined amount, and an area on the second free end portion 113 is cut out to correspond to the width-reduced first free end portion 112 for the latter to extend therethrough. With the handle portion 111, the two crossed free end portions 112, 113 may be compressed relative to one another to elastically enlarge the inner diameter of the ferrule 11, so that the ferrule 11 may be easily put around or shifted along or removed from the pen 20. When the two free end portions 112, 113 are released, the ferrule 11 immediately elastically returns to its original diameter and firmly locates on the pen 20 at a desired position. Therefore, the ferrule 11 is easily adapted to mount on any pen 20 having an outer diameter slightly larger than the inner diameter of the ferrule 11. The pen 20 may be provided with a small section 21 having a slightly reduced outer diameter, so that the ferrule 11 may be put around the diameter-reduced section 21 to be flush with the other part of the pen 20 and give the pen 20 a beautiful appearance. Moreover, the ferrule 11 may be easily put around the pen 20 and oriented to any desired direction before it is firmly located on the pen 20.

Figure 3:
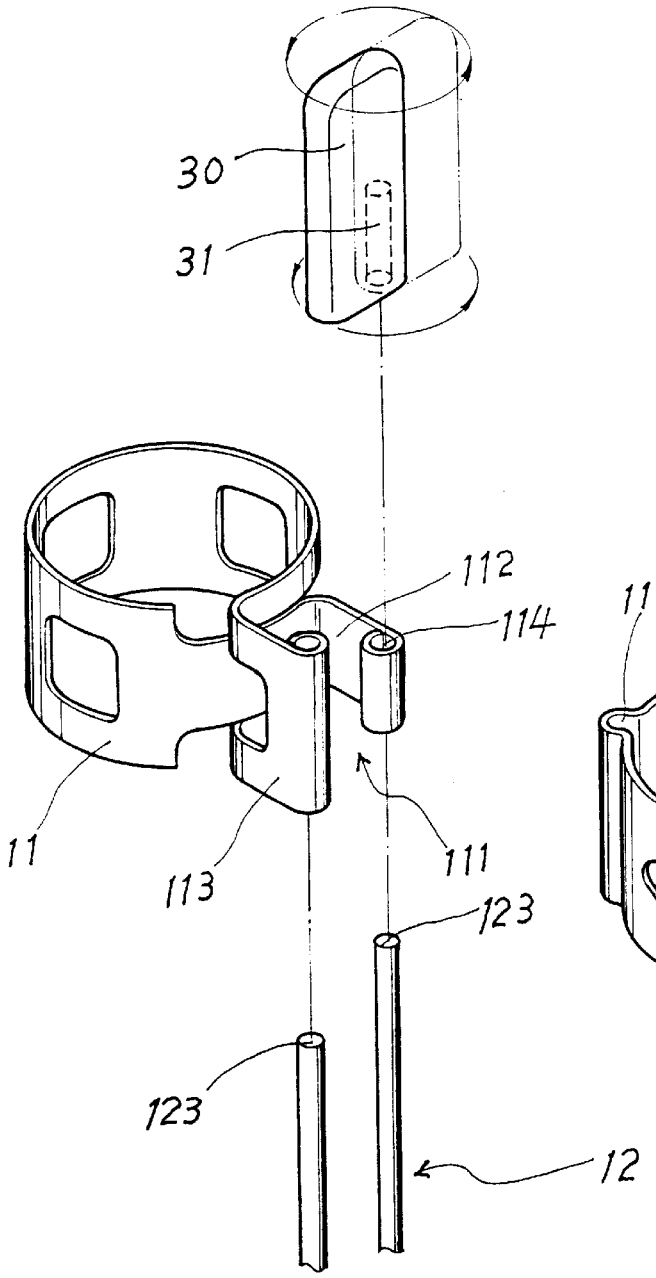
FIG. 3 is a fragmentary exploded perspective of the two-piece clip of the present invention showing a first variant of a ferrule thereof.

The two free end portions 112, 113 forming the handle portion 111 are curved at their outermost ends to form two small hollow cylinders, each of which defines a small long space 114 therein. The free end portions 112, 113 may be either curved outward as shown in FIG. 2, or curved inward as shown in FIG. 3. In either case, the curved outermost ends of the free end portions 112, 113 have thickened and smooth contour to facilitate better contact of fingers with the handle portion 111 when the latter is to be compressed to elastically enlarge the inner diameter of the ferrule 11.

The clip member 12 may be integrally made of, for example, a metal wire having a round cross-section, such as a steel wire having a diameter about 1.5 mm. The clip member 12 is formed by bending the metal wire into a generally U-shaped member. Two free ends 123 at an open side of the U-shaped clip member 12 are adapted to insert into the two small long spaces 114 provided on the ferrule 11. A closed side of the U-shaped clip member 12 is so bent that an inward projected portion 121 is formed to suitably abut on the pen 20 and an outward projected portion 122 is extended from the inward projected portion 121 to facilitate easy clamping of the clip member 12 onto something, such as a pocket or a sheet of paper, via the outward projected portion 122. With these arrangements, the ferrule 11 and the clip member 12 forming the clip 10 can be easily assembled or disassembled depending on actual need.

Figure 5:
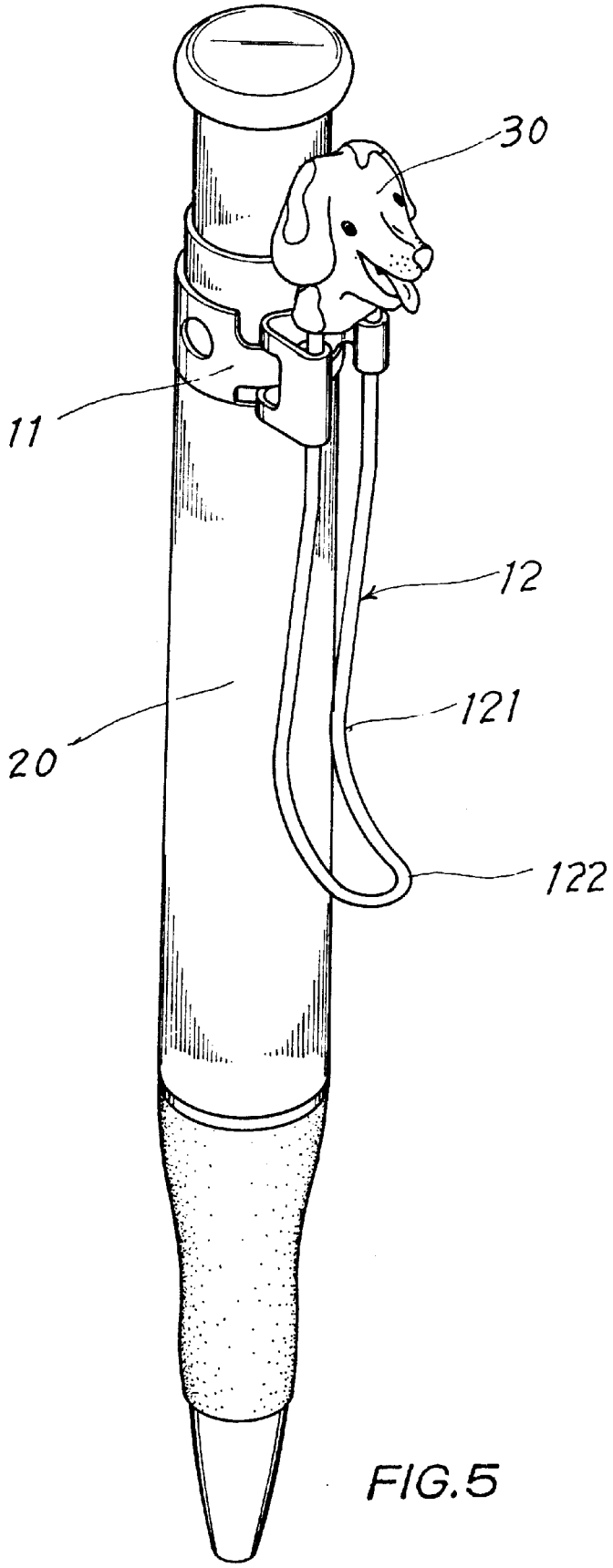
FIG. 5 is a perspective showing the two-piece clip of the present invention being mounted on a pen with a three-dimensional ornament connected thereto.

The free ends 123 at the open side of the clip member 12 are allowed to extend beyond the small long spaces 114 on the ferrule 11 by a suitable length for an ornamental article 30 to connect thereto. The ornamental article 30 may be a flat article of any shape with desired design or picture imprinted thereon, as shown in FIGS. 1 and 2. Two insertion holes (not shown) may be provided at a backside of the flat article 30 for receiving the two free ends 123 of the clip member 12 upward projected from the ferrule 11. Alternately, only one of the two free ends 123 is extended beyond the small long spaces 114 and the flat article 30 may have only one insertion hole 31 provided at a backside thereof, as shown in FIG. 3, for pivotally turnably connecting to the only one extended free end 123. Or, the ornamental article 30 may be a three-dimensional article, as shown in FIG. 5, to create more funs. The ornamental article 30 may also serve as a good advertising means.

The ferrule 11 may be of any suitable width, so long as it can be mounted around the pen 20 without undesirably sliding on the pen 20 or causing undesirable swinging of the clip member 12 relative to the pen 20. The ferrule 11 is not limited to any specific inner diameter. However, it is preferable that the ferrule 11 has an inner diameter slightly smaller than the outer diameters of regular pens, so that the ferrule 11 can be easily put around and located on a pen simply by compressing the handle portion 111 to obtain a desired inner diameter matching with the outer diameter of the pen.

The pen 20 is not necessarily limited to have any specific cross section, either, so long as the ferrule 11 can be easily put around the pen through the above-mentioned elastic adjusting of the ferrule inner diameter through the handle portion 111.

Figure 4:
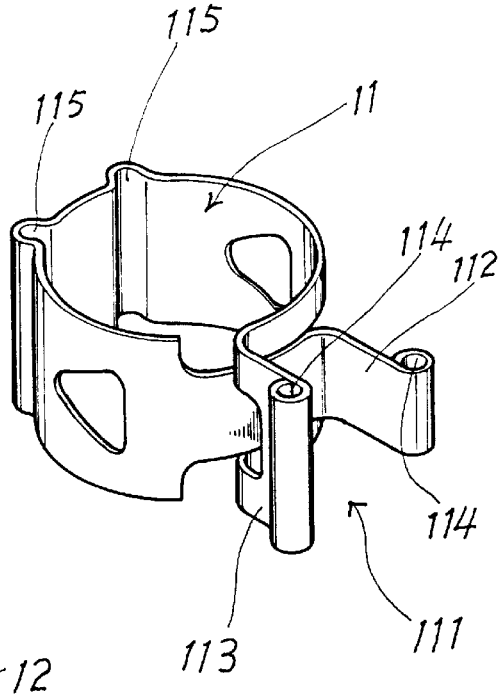
FIG. 4 is a perspective of a second variant of the ferrule of the two-piece clip of the present invention.

FIG. 4 illustrates another variant of the ferrule 11. In this variant, the ferrule 11 is further provided at other suitable positions thereof with one or more means 115 for connecting more ornamental and advertising articles 30 to the ferrule 11 and accordingly the clip 10. Or, the free ends 123 of the clip member 12 may have increased length, so that they may connect the ornamental article 30 to them before being turned toward the additional means 115 to connect additional ornamental articles 30 to them.

What is claimed is:

1. A two-piece clip with an elastically adjustable ferrule, comprising a ferrule and a clip member that are easily detachably connected to each other;

said ferrule being formed from a long strip with a predetermined elasticity and rigidity and having a predetermined inner diameter, two free end portions of said long strip forming said ferrule being caused to cross each other and form a handle portion outside said ferrule; said ferrule being elastically adjustable to enlarge its inner diameter by applying a compressive force on said handle portion to push said free end portions, inward relative to each other, or being elastically adjustable to return its original inner diameter by releasing said free end portions; said free end portions being curved at their outermost ends to define a thickened and smooth contour to facilitate better contact of fingers with said free end portions to apply a compressive force thereon, and said outermost ends also defining two small long spaces therein; and said clip member being made of a metal wire material that is bent into a generally U-shaped clip member, two free ends at an open side of said U-shaped clip member being adapted to insert into said two small long spaces at said two free end portions of said ferrule, and a closed side of said U-shaped clip member being bent to form an inward projected portion to abut on a pen to which said clip is mounted and an outward projected portion extended from said inward projected portion to facilitate easy clamp of said clip member onto a pocket or a sheet of paper.

2. A two-piece clip with an elastically adjustable ferrule as claimed in claim 1, wherein said two free ends at the open side of said U-shaped clip member are inserted into said two small long spaces of said two free end portions of said ferrule to upward project therefrom by a predetermined length for connecting, an ornamental or advertising article thereto.

3. A two-piece clip with an elastically adjustable ferrule as claimed in claim 2, wherein said ornamental or advertising article may be either a flat or a three-dimensional article of any shape with two insertion holes provided thereon for said two free ends of said clip member projected from said small long spaces of said ferrule to insert thereinto and thereby connecting said ornamental or advertising article to said clip, and wherein said ornamental or advertising article is provided with sufficient area for showing ornamental or advertising design or picture thereon.

4. A two-piece clip with an elastically adjustable ferrule as claimed in claim 2, wherein said ornamental or advertising article may be either a flat or a three-dimensional article of any shape with one insertion holes provided thereon for one of said two free ends of said clip member projected from said small long spaces of said ferrule to insert thereinto and thereby pivotally connecting said ornamental or advertising article to said clip, and wherein said ornamental or advertising article is provided with sufficient area for showing ornamental or advertising design or picture thereon.

5. A two-piece clip with an elastically adjustable ferrule as claimed in claim 1, wherein said outermost ends of said two free end portions of said ferrule forming said handle portion are outward curved.

6. A two-piece clip with an elastically adjustable ferrule as claimed in claim 1, wherein said outermost ends of said two free end portions of said ferrule forming said handle portion are inward curved.

7. A two-piece clip with an elastically adjustable ferrule as claimed in claim 1, wherein said outermost ends of said two free end portions of said ferrule are preferably curved into two small hollow cylinders to each define a small long space having a round cross section, whereby said clip member may be correspondingly formed from a metal wire having a round cross section for easily inserting into said small hollow cylinders on said ferrule.

8. A two-piece clip with an elastically adjustable ferrule as claimed in claim 1, wherein said ferrule is not necessarily limited to any specific inner diameter but it is preferable that said ferrule has an inner diameter slightly smaller than outer diameters of regular pens, so that said ferrule can be easily put around and located on a pen simply by compressing said handle portion to elastically enlarge said inner diameter of said ferrule.

9. A two-piece clip with an elastically adjustable ferrule as claimed in claim 1, wherein said ferrule of said clip is further formed at other predetermined positions with additional means adapted to connect additional ornamental or advertising articles to said ferrule and accordingly said clip.

* * * * *